US009725833B2

(12) United States Patent
Hasko et al.

(10) Patent No.: US 9,725,833 B2
(45) Date of Patent: Aug. 8, 2017

(54) WOVEN STRUCTURE AND METHOD FOR WEAVING SAME

(75) Inventors: Gregory H. Hasko, Southington, CT (US); Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 816 days.

(21) Appl. No.: 13/547,410

(22) Filed: Jul. 12, 2012

(65) Prior Publication Data

US 2014/0014223 A1 Jan. 16, 2014

(51) Int. Cl.

| | |
|---|---|
| ***D03D 41/00*** | (2006.01) |
| ***D03D 23/00*** | (2006.01) |
| ***D03D 47/12*** | (2006.01) |
| *D03D 13/00* | (2006.01) |

(52) U.S. Cl.

CPC ..... *D03D 23/00* (2013.01); *D03D 41/004* (2013.01); *D03D 47/12* (2013.01)

(58) Field of Classification Search

CPC ..... D03D 41/004; D03D 25/005; D03D 41/00
USPC ..... 139/11, 192, DIG. 1, 48, 35, 50
See application file for complete search history.

(56) References Cited

U.S. PATENT DOCUMENTS

| | | | | |
|---|---|---|---|---|
| 1,243,079 | A | 10/1917 | Lloyd | |
| 1,339,064 | A | 5/1920 | Lloyd | |
| 2,998,030 | A * | 8/1961 | Koppelman et al. | 139/387 R |
| 4,019,540 | A * | 4/1977 | Holman et al. | 139/20 |
| 4,109,355 | A | 8/1978 | Davitian | |
| 4,200,677 | A * | 4/1980 | Bottini et al. | 442/254 |
| 4,298,122 | A * | 11/1981 | Ekelund | 206/389 |
| 4,412,854 | A * | 11/1983 | Layden | 65/442 |
| 4,581,053 | A * | 4/1986 | Prewo et al. | 65/442 |
| 4,613,473 | A * | 9/1986 | Layden et al. | 264/103 |
| 5,104,726 | A * | 4/1992 | Ross | 442/207 |
| 5,431,193 | A * | 7/1995 | Mood et al. | 139/11 |
| 5,501,133 | A * | 3/1996 | Brookstein et al. | 87/33 |
| 5,778,736 | A * | 7/1998 | Maass et al. | 74/572.12 |
| 6,000,442 | A * | 12/1999 | Busgen | 139/389 |
| 6,007,319 | A * | 12/1999 | Jacobson | 425/140 |
| 6,086,968 | A * | 7/2000 | Horovitz | 428/36.1 |
| 6,470,916 | B1 * | 10/2002 | Uchida et al. | 139/11 |
| 6,742,547 | B2 * | 6/2004 | Bryn et al. | 139/383 R |
| 6,892,766 | B2 * | 5/2005 | Bryn et al. | 139/11 |
| 7,805,213 | B2 | 9/2010 | Schwenn | |
| 2003/0175489 | A1 * | 9/2003 | Dolby | 428/298.1 |
| 2007/0117486 | A1 * | 5/2007 | Serillon | 442/203 |

(Continued)

FOREIGN PATENT DOCUMENTS

| | | |
|---|---|---|
| DE | 102010007048 | 8/2011 |
| EP | 0474090 | 3/1992 |

(Continued)

OTHER PUBLICATIONS

Automated Dynamics, www.automateddynamics.com, 2008-2012, p. 1.

Coriolis composites—Robot and software for fiber placement, The use of robots for fiber placement, www.coriolis-composites.com, 2008, p. 1, Lorient, France.

(Continued)

*Primary Examiner* — Bobby Muromoto, Jr.

(74) *Attorney, Agent, or Firm* — Carlson, Gaskey & Olds, P.C.

(57) ABSTRACT

An exemplary weaving method includes placing a first section of a fill fiber between warp fibers, forming a pick, moving a base to reposition the warp fibers, and placing a second section of the fill fiber between the warp fibers.

20 Claims, 6 Drawing Sheets

(56) References Cited

U.S. PATENT DOCUMENTS

| | | | | |
|---|---|---|---|---|
| 2008/0300602 | A1 | 12/2008 | Schmitt et al. | |
| 2010/0269948 | A1 | 10/2010 | Legrand et al. | |
| 2010/0319801 | A1 | 12/2010 | Legrand et al. | |
| 2011/0265905 | A1 | 11/2011 | Kuhl et al. | |
| 2013/0004326 | A1* | 1/2013 | McCaffrey | 416/241 B |
| 2013/0052030 | A1* | 2/2013 | McCaffrey | 416/241 B |

FOREIGN PATENT DOCUMENTS

| | | | |
|---|---|---|---|
| GB | 2066308 | | 7/1981 |
| JP | H0411043 | A | 1/1992 |
| JP | 2010095807 | A | 4/2010 |
| WO | 9940875 | A1 | 8/1999 |
| WO | 2008018438 | | 2/2008 |

OTHER PUBLICATIONS

Michael McClain and Jonathan Goering, Overview of Recent Developments in 3D Structures, pp. 1-12, Rochester, NH.

www.threadsmagazine.com, p. 1, 2012.

Talzhemir's Intro to Kumihimo, The Japanese Art of Crafting Cords, p. 1, 2007.

Kumihimo Marudai, Japanese Braiding Stands, www.ee0r.com, pp. 1-41, Sep. 2008, Oct. 2008, Nov. 2008, Jan. 2009.

International Search Report and Written Opinion for International Application No. PCT/US2013/047019 completed on Sep. 23, 2013.

International Preliminary Report on Patentability for PCT Application No. PCT/US2013/047019, mailed Jan. 22, 2015.

European Search Report for European Application No. 13815972.8 dated Jul. 1, 2015.

* cited by examiner

WOVEN STRUCTURE AND METHOD FOR WEAVING SAME

BACKGROUND

This disclosure relates generally to a woven structure and, more particularly, to weaving a structure that has varying contours.

Woven structures are known. Woven structures are made of multiple picks along the formation direction. In some traditional weaving techniques, the term "pick" describes one fill fiber that has been deposited and encapsulated by the entire array of warp fibers one row at a time. The term "pick" may apply to encapsulation of the fill fiber by one adjacent pair of warp fibers at a time.

Many components, such as ceramic matrix composite (CMC) or organic matrix composite (OMC) components used in a jet engine, use woven structures as preforms. The woven structure strengthens the component. During manufacturing of such components, the woven structure is placed in a mold as a precursor. A material is then injected into the remaining areas of the mold. The injected material or resin surrounds the woven structure within the mold. If the mold has varying contours, manipulating woven assemblies, which are relatively planar, into a shape suitable for placing into the mold is difficult. Existing techniques for such manipulation may weaken the woven structures.

SUMMARY

A weaving method according to an exemplary aspect of the present disclosure includes placing a first section of a fill fiber between warp fibers, forming a pick, moving a base to reposition the warp fibers, and placing a second section of the fill fiber between the warp fibers.

In a further non-limiting embodiment of the foregoing weaving method, the method may secure the warp fibers to the base.

In a further non-limiting embodiment of either of the foregoing weaving methods, the method may include adhesively securing the warp fibers to the base.

In a further non-limiting embodiment of any of the foregoing weaving methods, the method may include moving the warp fibers after placing the first section and before placing the second section.

In a further non-limiting embodiment of any of the foregoing weaving methods, the method may include crossing the warp fibers over the first section before placing the second section.

In a further non-limiting embodiment of any of the foregoing weaving methods, the method may include injecting a molding material around at least a portion of the pick.

In a further non-limiting embodiment of any of the foregoing weaving methods, the method may include placing using a wand, the base moveable relative to the wand.

In a further non-limiting embodiment of any of the foregoing weaving methods, the method may include forming another pick with the second section.

A weaving method according to another exemplary aspect of the present disclosure includes forming a first pick, repositioning warp fibers by moving warp fiber arms relative to a fill fiber wand, repositioning warp fibers by moving the base relative to the fill fiber wand, and forming a second pick. Each of the warp fibers extend from one of the warp fiber arms to the base.

In a further non-limiting embodiment of the foregoing weaving method, the base may be configured to move relative to the fill fiber wand in three dimensions during the repositioning.

In a further non-limiting embodiment of either of the foregoing weaving methods, the base may be configured to move relative to the fill fiber wand around three axes of rotation during the repositioning.

In a further non-limiting embodiment of any of the foregoing weaving methods, the warp fibers are adhesively secured to the base.

In a further non-limiting embodiment of any of the foregoing weaving methods, the method may include positioning a fill fiber using the fill fiber wand.

In a further non-limiting embodiment of any of the foregoing weaving methods, the method may include forming the first pick comprises entrapping a first portion of a fill fiber between warp fibers.

In a further non-limiting embodiment of any of the foregoing weaving methods, the method may include crossing the warp fibers over the first section before placing the second section.

A weaving assembly according to an exemplary aspect of the present disclosure includes, among other things, a wand configured to position a first portion of a fill fiber woven between warp fibers to provide a pick, and a base that is moveable relative to the wand to adjust the position of the warp fibers.

In a further non-limiting embodiment of the foregoing weaving assembly, warp fiber arms may be each configured to move a respective one the warp fibers to a position that entraps the first portion of the fill fiber.

In a further non-limiting embodiment of either of the foregoing weaving assemblies, the fill fiber may comprise at least one of a glass, graphite, polyethelene, aramid, ceramic, boron.

In a further non-limiting embodiment of any of the foregoing weaving assemblies, the pick may be a portion of the woven structure.

In a further non-limiting embodiment of any of the foregoing weaving assemblies, the woven structure may comprise a portion of a base of a composite component.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
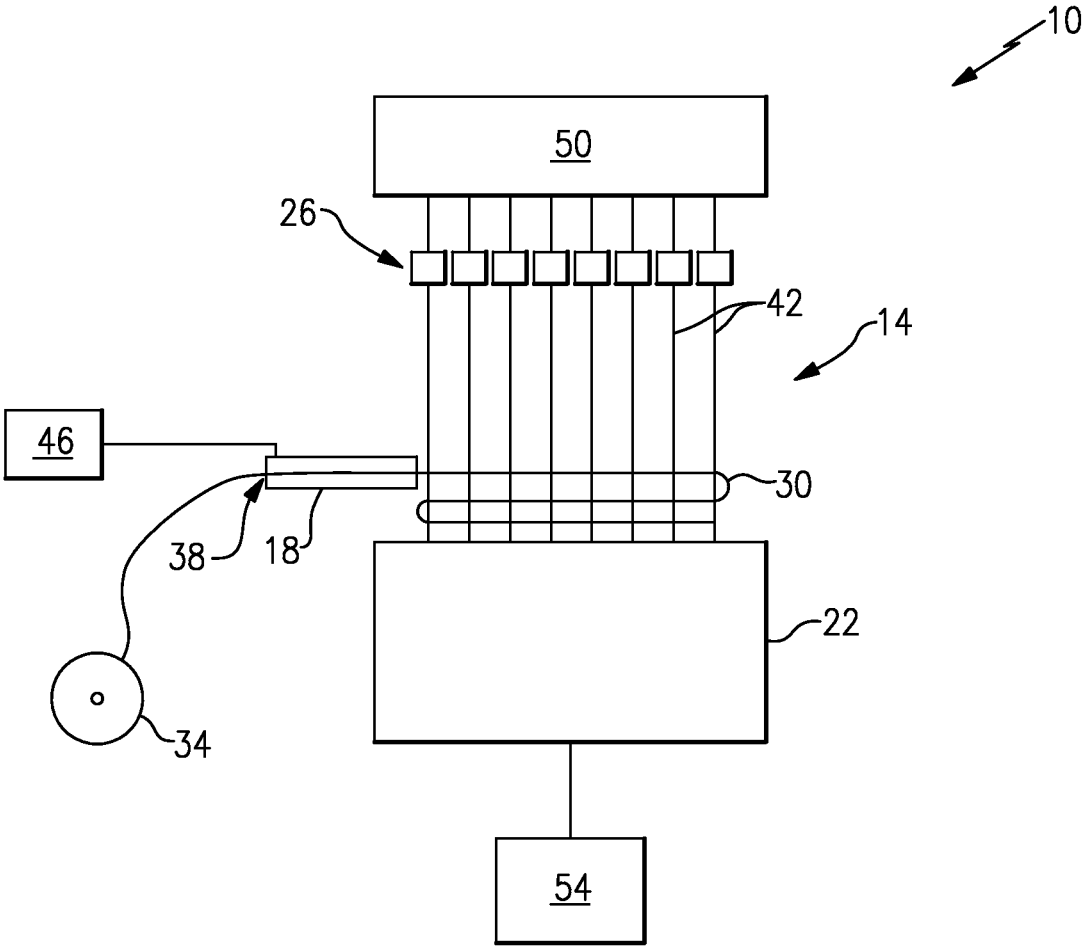
FIG. 1 shows a schematic view of an example weaving assembly.
Figure 2:
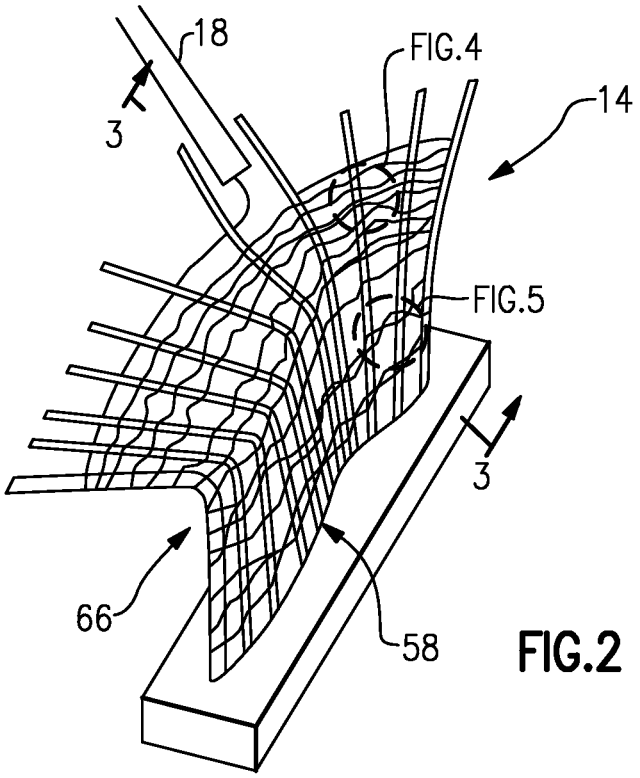
FIG. 2 shows a perspective view of a portion of the FIG. 1 weaving assembly having a partially finished woven structure.
Figure 3:
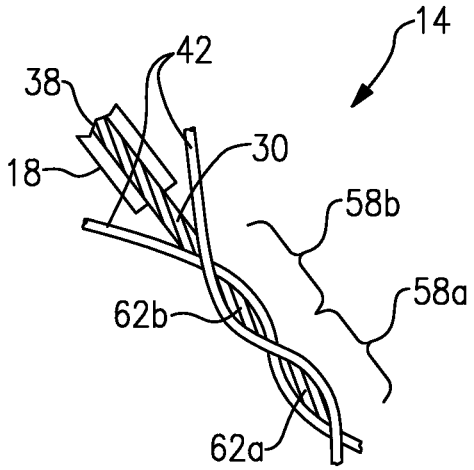
FIG. 3 shows a section view at line 3-3 in FIG. 2.
Figure 4:
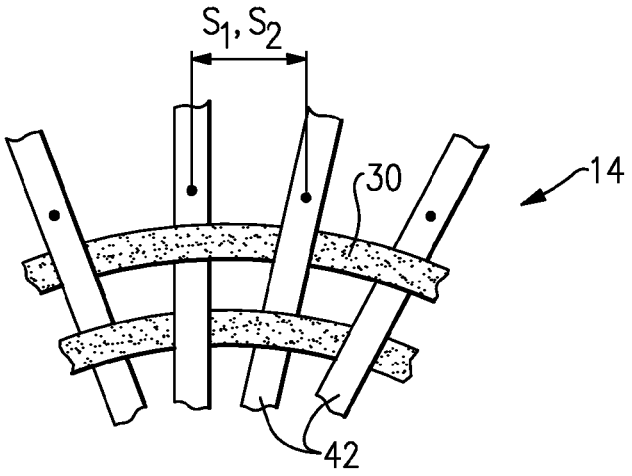
FIG. 4 shows a close-up view of an Area 4 of the woven structure during the weaving.
Figure 5:
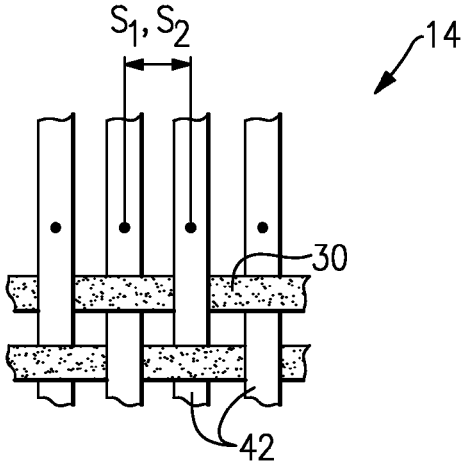
FIG. 5 shows a close-up view of an Area 5 of the woven structure during the weaving.
Figure 6:
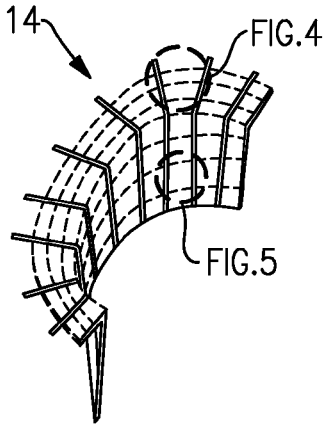
FIG. 6 shows an example finished woven structure.
Figure 7:
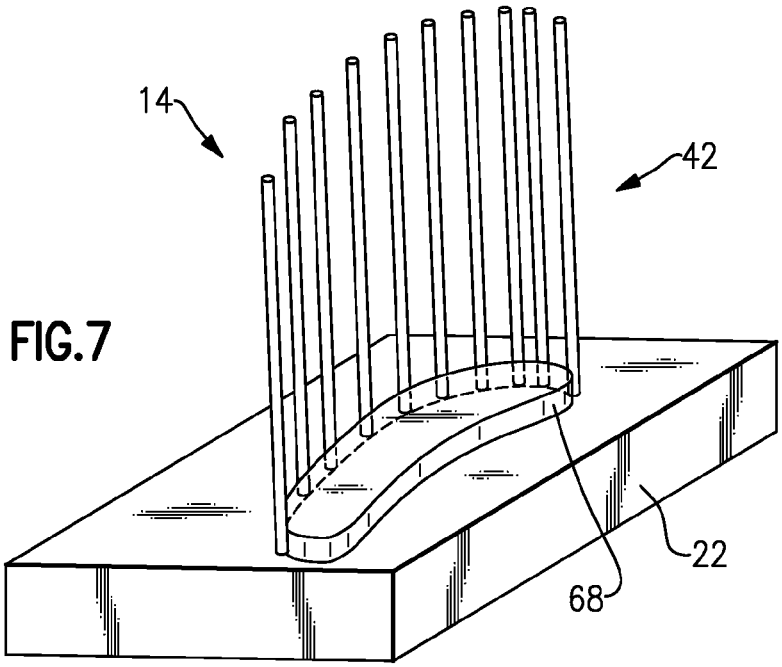
FIG. 7 shows a perspective close-up view of a base of the FIG. 1 weaving assembly, showing discrete warp fibers attached, prior to weaving the structure of FIG. 2.

Referring to FIG. 1, an example weaving assembly 10 is used to weave a woven structure 14. The weaving assembly 10 includes a wand 18, a base 22, and a plurality of warp fiber arms 26.

When weaving the woven structure 14, the wand 18 positions a fill fiber 30 between warp fibers 42. The fill fiber 30 extends from a spool 34 through a bore 38 in the wand 18. The wand 18, in this example, is a hollow tube. A fill fiber feed device may be included to meter the feed rate of the fill fiber with respect to the instantaneous relative velocity of the wand tip to the textile being created. The warp fibers 42 are manipulated by warp fiber arms 26.

The assembly 10 includes a positional controller 46 associated with the wand 18, a positional controller 50 associated with the warp fiber arms 26, and a positional controller 54 associated with the base 22. The positional controller 46 is able to move the wand 18 relative to the warp fiber arms 26 and the base 22. The positional controller 50 is able to move the warp fiber arms 26 relative to the wand 18 and the base 22. The positional controller 54 is able to move the base 22 relative to the wand 18 and the warp fiber arms 26. The positional controllers 46, 50, and 54 can be operated independently from each other or together.

The warp fiber arms 26 may be on the positional controller 50, attached to the fill fiber wand controller 46, or attached to the base positional controller 54.

In this example, at least the positional controller 54 is a six-axis controller, and may be a six-axis robotic controller. That is, the positional controller 54 is able to move the base 22 relative to the warp fiber arms 26 in three dimensions and rotate around three axes. The positional controllers 46 and 50 may have similar characteristics.

Referring to FIGS. 2-8 with continuing reference to FIG. 1, the woven structure 14 includes multiple picks 58. In this example, warp fibers 42 are crossed over a first section 62 of the fill fiber 30 to form one of the picks 58*a*. The warp fiber arms 26 are actuated to cross the warp fibers 42 over the fill fiber 30, which entraps the fill fiber to form the pick 58*a*.

The example fill fibers 30 and warp fibers 42 may be composed of several different materials including glass, graphite, polyethelene, aramid, ceramic, boron. One of the fill fibers 30 or warp fibers 42 may include hundreds or thousands of individual filaments. The individual filaments may have diameters that range from 5 to 25 microns, although boron filaments may be up to 142 microns in diameter.

In this example, each of the warp fiber arms 26 holds one of the warp fibers 42. In other examples, the warp fiber arms 26 may hold several of the warp fibers 42. After crossing the warp fibers 42 over the fill fiber 30, the warp fiber arms 26 hand-off the warp fiber 42 to another of the warp fiber arms 26. The "hand-off" feature allows an open shed so that the warp fiber arms 26 do not interfere with the wand 18. After the hand-off, the warp fiber arms 26 are then crossed over a second section 62*b* of the fill fiber 30 to form another of the picks 58*b*.

The warp fiber arms 26 engage portions of the warp fibers 42. These portions may include end fittings. The warp fiber arms 26 grab the end fittings holding the warp fibers 42. The end fittings may be placed on a holding station to help maintain the position of the warp fibers 42 during weaving.

A person having skill in this art and the benefit of this disclosure would understand how to create picks by crossing warp fibers over a fill fiber, and how to hand-off a warp fiber from one warp fiber arm to another warp fiber arm.

Figure 8:
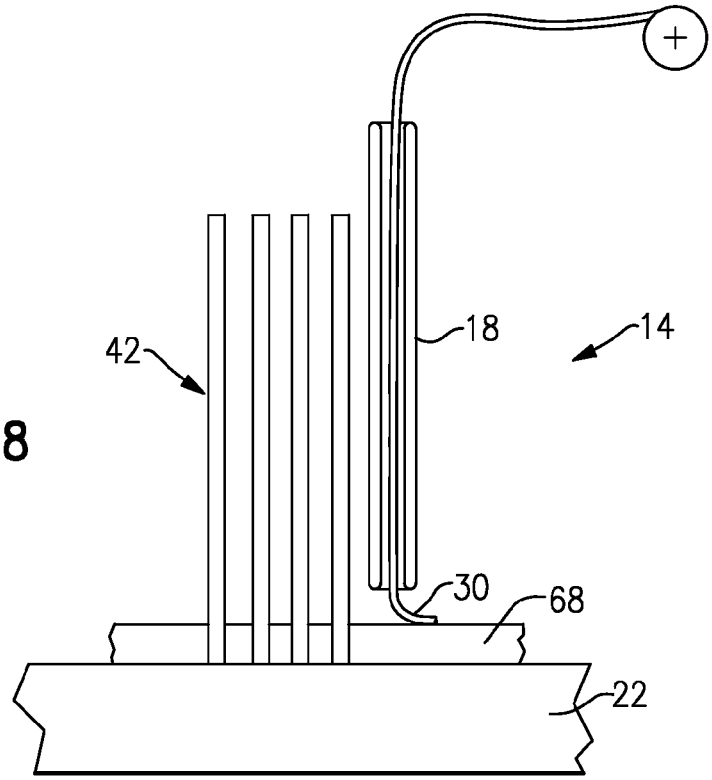
FIG. 8 shows a side view of a base of the FIG. 1 weaving assembly when weaving the structure of FIG. 2.

When weaving, the wand 18 moves the fill fiber 30 past the warp fibers 42. The wand 18 moves the fill fiber 30 back and forth to create built-up layers of picks 58. The wand 18 is long enough to reach down through the longest warp fibers 42 during the weaving (FIG. 8).

In this example, the base 22 is moved as dictated by the design of the woven structure 14 to create a bend 66 in the woven structure 14. The base 22 is thus capable of movement relative to the warp fiber arms 26. A boss 68 of the base 22 directly engages one end of the warp fibers 42. The warp fibers 42 are adhesively secured to base 68 in some examples.

The base 22 moves so that the pick_formation point is at a position relative to the wand 18, and the fill fiber 30, appropriate for forming the bend 66. Although only one substantial bend 66 is shown, the base 22 may manipulate the pick formation points to form a woven structure having various contours.

The base 22 may move the warp fibers 42 over a piece of tooling shaped to the final desired contour [e.g., a mandrel] that is attached to the base 22 to facilitate forming the bend 66. The mandrel may move separately from the base 22. In another example, the base 22 moves the warp fibers 42 without a mandrel to free-form the bend 66.

In some examples, the warp fibers 42 are rigid enough to cantilever out from the base 22 (or shed) during the weaving. A binding agent such as polyvinyl alcohol is used, in some examples, to provide a degree of rigidity to the warp fibers 42. The warp fibers 42 may have a fixed length. The fill fiber 30, by contrast, can have length in excess of that needed to produce one component.

In some examples, the warp fibers 42 are soft and not rigid enough to cantilever out from the base. In other examples, metallic or plastic fittings may be added to the free ends of flexible warp fibers 42. The fittings may be placed in holding stations, and the warp arms move the fittings from notch to notch as appropriate as the component is build up.

The fittings may take the form of a bead with a through-hole. Prior to weaving, the ends of the warp fibers 42 are inserted through the holes and bonded with an adhesive. The holding station may be a fixture that has notches to hold the non-rigid warp fibers by draping the fitting over the notch and having gravity provide tension. The fittings may also take the form of mechanisms that provide tension by the action of a spring, similar to carriers that hold spools of fiber on a braiding machine. The holding station may be attached to the base or may be independent of the motion of the base.

The path and manipulations of the base 22 with the positional controller 54, the number of warp fibers 42 engaged by the warp fiber arms 26 when forming each pick, and the sequence of warp fiber arm movements may be designed and pre-planned in a software model to produce the woven structure 14 having the desired contours. A stable shape is obtained by the interplay of fiber forces and friction within the textile unit cells throughout the component.

The software model may utilize as inputs: a CAD definition of the surfaces of a desired component incorporating the woven structure; a definition of the initial warp fibers' lengths, locations, and orientations; and a definition of a textile repeating unit cell (or pick). The software calculates motions of the wand 18, base 22, and warp fiber arms 26 necessary to achieve desired contours in the woven structure 14, without colliding into each other. The software model is then used as input for the positional controllers 46, 50, and 54.

Figure 9A:
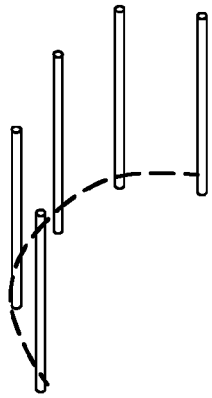
FIG. 9A shows a partial view an area of the woven structure during an initial weaving step.
Figure 9B:
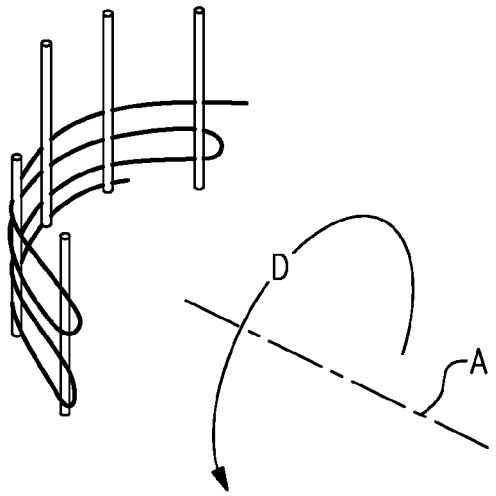
FIG. 9B shows a partial view an area of the woven structure during a weaving step later than what is shown in FIG. 9A.
Figure 9C:
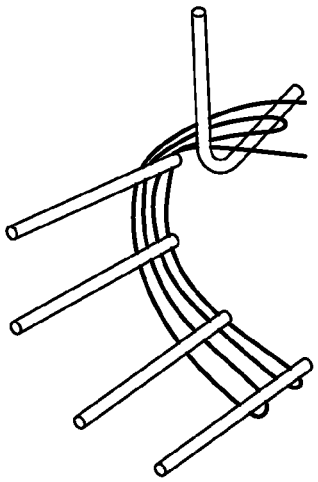
FIG. 9C shows a partial view an area of the woven structure during a weaving step later than what is shown in FIG. 9B.

FIGS. 9A-9C show an example of the manipulation and sequencing used when weaving to create the woven structure 14. The warp fibers 42 of this example may be attached to a base having a profile matching a portion of the woven structure 14. The fill fiber 30 is then moved through the warp fibers 42 in multiple passes. The warp fibers 42 are then turned about an axis A in a direction D to develop, for example, a flange of the woven structure 14 and the bend 66.

Figure 10:
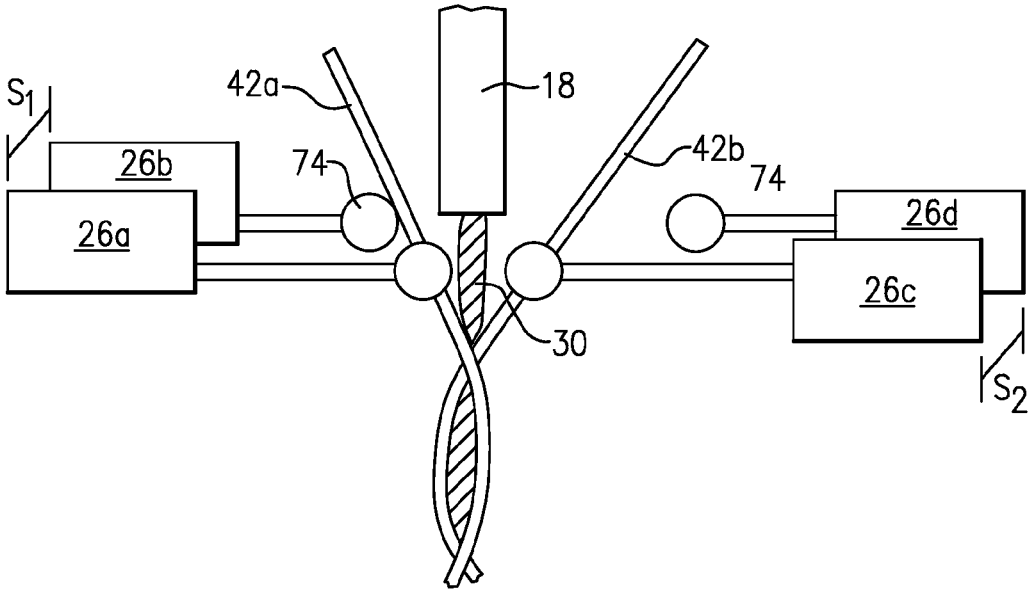
FIG. 10 shows a close-up view of warp handling arms of the FIG. 1 weaving assembly when weaving the structure of FIG. 2.

FIG. 10 shows an example warp manipulation station 70 having four warp fiber arms 26*a*-26*d*. Two of the arms 26*a* and 26*c* selectively engage the warp fiber 42*a*, and two of the arms 26*b* and 26*d* selectively engage the warp fiber 42*b*. Each of the arms 26*a*-26*d* may have a gripper 74 in order to push and pull the respective-warp fiber 42*a* or 42*b* over the fill fiber 30.

In this example, after forming a pick, the arm 26*a* hands-off the warp fiber 42*a* to the arm 26*d*, and the arm 26*c* hands-off the warp fiber 42*b* to the arm 26*b*. By handing off and retracting, the warp arms divide the warp fibers 42*a* and 42*b* to open a shed area between the warp fibers 42*a* and 42*b* for the wand 18.

Separation $S_1$ between arms 26*a* and 26*b*, and separation $S_2$ between arms 26*c* and 26*d* can be adjusted to adjust the shape of the woven structure 14. The separations $S_1$ and $S_2$ may remain relatively consistent when forming the area shown in FIG. 5. The separations $S_1$ and $S_2$ may be gradually increased after each pass of the fill fiber 30 to create a flanged area of the woven structure 14 shown in FIG. 4.

Figure 11:
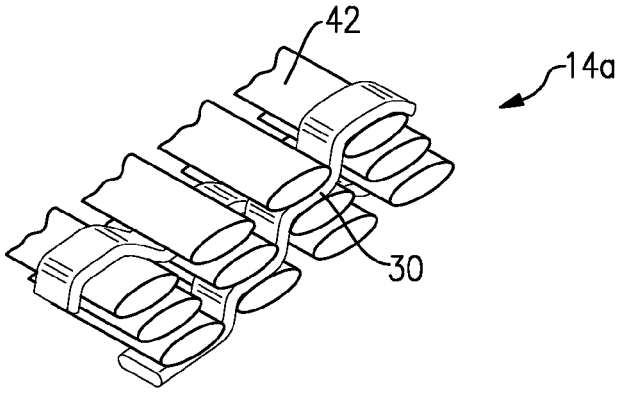
FIG. 11 shows a close-up view of a woven structure having multiple layers.

Referring to FIG. 11, in some examples a woven structure 14*a* may include multiple layers of the warp fibers 42. The fill fiber 30 joins all three layers in this example. Grippers used when weaving the woven structure 14*a* selectively engage one, two, or more warp fibers.

In another embodiment the warp fiber arms 26*a*-26*d* may be mounted on a housing with the fill fiber wand 18. The warp fiber arms 26*a*-26*d* may have small paddle extensions that can be inserted next to the warp fibers 42, and are under multi-axis position control with respect to the fill fiber wand 18, to nudge and guide the warp fibers 42 into position as dictated by the software model of the component being created.

Features of the disclosed examples include a relatively precise and repeatable mechanized process that is conducive to high volume production of complex shape engine components. Creation of textile architectures that avoid the pitfalls of traditional methods of low intralaminar and interlaminar properties is enabled.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A weaving method, comprising:

securing a plurality of warp fibers to a base, each of the warp fibers secured to the base at an attachment location;

placing a first section of a fill fiber between warp fibers; forming a pick;

moving the base in at least two directions to reposition the warp fibers, the at least two directions transverse to one another; and placing a second section of the fill fiber between the warp fibers.

2. The weaving method of claim 1, including adhesively securing the warp fibers to the base.

3. The weaving method of claim 1, including moving the warp fibers after placing the first section and before placing the second section.

4. The weaving method of claim 1, including crossing the warp fibers over the first section before placing the second section.

5. The weaving method of claim 1, including injecting a molding material around at least a portion of the pick.

6. The weaving method of claim 1, including placing using a wand, the base moveable relative to the wand.

7. The weaving method of claim 1, including forming another pick with the second section.

8. A weaving method, comprising:

securing a plurality of warp fibers to respective warp fiber arms;

forming a first pick;

repositioning warp fibers by moving warp fiber arms in at least two directions relative to a fill fiber wand, the at least two directions transverse to one another;

repositioning warp fibers by moving the base relative to the fill fiber wand; and forming a second pick, wherein each of the warp fibers extend from one of the warp fiber arms to the base.

9. The method of claim 8, wherein the base is configured to move relative to the fill fiber wand in three dimensions during the repositioning.

10. The method of claim 8, wherein the base is configured to move relative to the fill fiber wand around three axes of rotation during the repositioning.

11. The method of claim 8, wherein the warp fibers are adhesively secured to the base.

12. The method of claim 8, including positioning a fill fiber using the fill fiber wand.

13. The method of claim 8, wherein forming the first pick comprises entrapping a first portion of a fill fiber between warp fibers.

14. The method of claim 12, including crossing the warp fibers over the first section before placing the second section.

15. A weaving assembly, comprising, a wand configured to position a first portion of a fill fiber woven between warp fibers to provide a pick; and a base that is moveable relative to the wand to adjust the position of the warp fibers, each of the warp fibers secured to the base at one of a plurality of attachment locations, the base configured to move in at least two directions that are transverse to each other to move the attachment locations and adjust the positions of the warp fibers.

16. The weaving assembly of claim 15, including warp fiber arms each configured to move a respective one the warp fibers to a position that entraps the first portion of the fill fiber.

17. The weaving assembly of claim 15, wherein the fill fiber comprises at least one of a glass, graphite, polyethelene, aramid, ceramic, boron.

18. The weaving assembly of claim 15, wherein the pick is a portion of the woven structure.

19. The weaving assembly of claim 15, wherein the woven structure comprises a portion of a base of a composite component.

20. The weaving method of claim 1, including moving the base to move the warp fibers over of piece of tooling to form a bend.

* * * * *